United States Patent [19]

Shire, Sr. et al.

[11] 4,402,464

[45] Sep. 6, 1983

[54] SCRAP GRANULATOR

[76] Inventors: Harry E. Shire, Sr.; Harry E. Shire, Jr., both of 4985 E. M-71, Corunna, Mich. 48817

[21] Appl. No.: 257,516

[22] Filed: Apr. 27, 1981

[51] Int. Cl.[3] ..... B02C 13/284; B02C 13/286

[52] U.S. Cl. ..... 241/73; 241/154; 241/189 R; 241/190; 241/243

[58] Field of Search ..... 241/73, 154, 186 R, 241/187, 189 R, 189 A, 190, 243

[56] References Cited

U.S. PATENT DOCUMENTS

| | | | |
|---|---|---|---|
| 1,087,415 | 2/1914 | Welton . | |
| 1,181,967 | 5/1916 | Curtis et al. | |
| 1,528,201 | 7/1922 | Fritz . | |
| 1,561,093 | 4/1924 | McCargar . | |
| 1,645,770 | 4/1925 | Olson . | |
| 1,864,973 | 9/1929 | Buchanan . | |
| 3,151,814 | 10/1964 | Morgan et al. | 241/190 X |
| 3,378,210 | 4/1968 | Bambach . | |
| 3,462,087 | 8/1969 | Butler et al. | 241/186 R |
| 3,595,290 | 7/1971 | Tassev | 241/154 X |
| 4,082,231 | 4/1978 | Gould | 241/187 |
| 4,161,296 | 7/1979 | Parker et al. | |
| 4,166,583 | 9/1979 | Ruckstuhl | 241/73 |
| 4,183,471 | 1/1980 | Pfister | 241/73 X |

*Primary Examiner*—Howard N. Goldberg
*Attorney, Agent, or Firm*—Hauke and Patalidis

[57] ABSTRACT

A granulator or grinding mill comprising a pair of power driven drums mounted at the bottom of a housing. The first drum is provided on its periphery with a plurality of fingers or pins projecting through slots in an inclined plate hingedly secured to a side of the housing. The fingers or pins break various pieces of articles, such as unfired pottery and ceramic, dumped in the housing on top of the plate, the pieces falling to a lower level being those small enough to pass between consecutive fingers and a crushing plate mounted on the side of the housing. The pieces falling to a lower level are further broken and pulverized by a power driven cylinder provided on its surface with longitudinal bars. The bottom of the housing has an aperture masked by a removable screen of a predetermined mesh, such that only particles capable of passing through the screen and falling in a receptacle are reused, for example for making a slurry for manufacturing ceramic or pottery.

5 Claims, 5 Drawing Figures

SCRAP GRANULATOR

BACKGROUND OF THE INVENTION

The invention relates in general to grinding mills and in particular to a granulator for converting large chunks of scrap articles such as unfired scrap pottery and ceramic into granulates for reuse in making slurry for molding finished articles.

During the manufacture of pottery and ceramic articles there is a considerable amount of wasted material, such as articles accidentally broken prior to firing, while unmolding the articles or during storage prior to firing, and dried out slurry overflowing from the molds. In addition there is a very large amount of rejects and scrap, which all add up to a sizable proportion of the tonnage of raw material purchased by a manufacturing plant in a given period of time. A similar problem is present in other manufacturing operations such as, for example, in the manufacture of thermoplastic articles.

SUMMARY OF THE INVENTION

The present invention permits to reuse such scrap material by grinding it to powder which, for example in ceramic manufacturing plant, can be reused by addition of an appropriate quantity of water for making a slurry for manufacturing articles.

In furtherance of this object, the invention provides a granulator in the form of a grinding mill in which broken ceramic articles, rejects, scrap and other residues are dumped, and at the bottom of which a reusable powder is obtained. The granulator of the invention utilizes a pair of power driven grinding drums disposed at the bottom of a hopper, the first drum being provided with peripherally projecting fingers or pins for breaking and churning the scrap pieces against a crushing bar disposed in the housing of the granulator. The pieces, small enough to fall to a lower level are further broken and churned by a second drum provided on its surfaces with longitudinal bars. An aperture, disposed at the bottom of the housing, is provided with a removable screen of a predetermined mesh size. Only particles capable of passing through the screen are used for making a slurry.

The diverse objects and advantages of the present invention will become apparent to those skilled in the art when the following description of the best mode contemplated for practicing the invention is read in conjunction with the accompanying drawings wherein:

DETAILED DESCRIPTION OF THE PREFERRED EMBODIMENT

Figure 1:
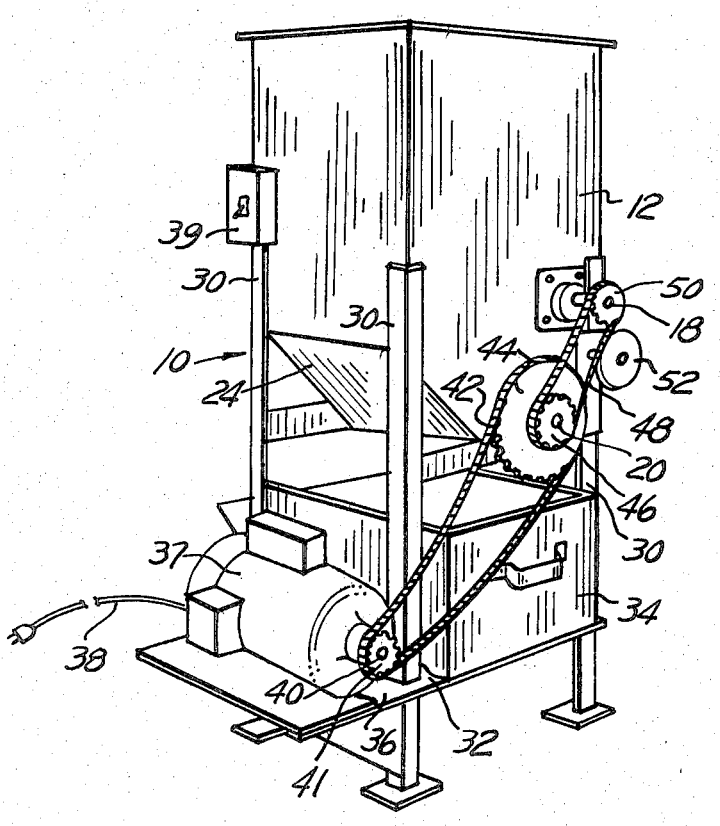
FIG. 1 is a perspective view of a grinding mill or granulator according to the present invention.
Figure 2:
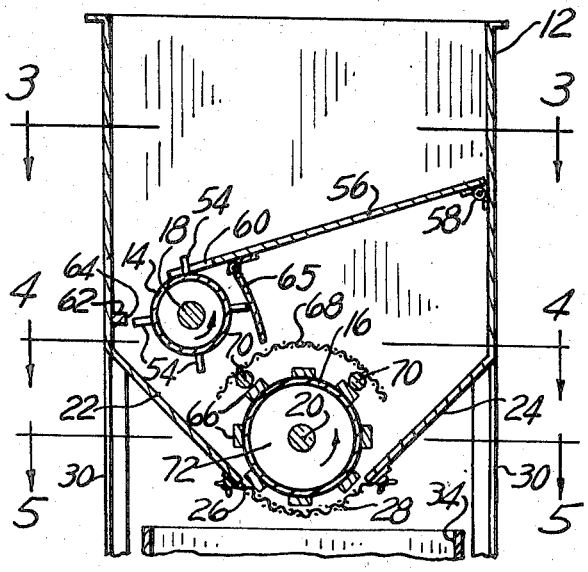
FIG. 2 is a partial transverse sectional view thereof.
Figure 3:
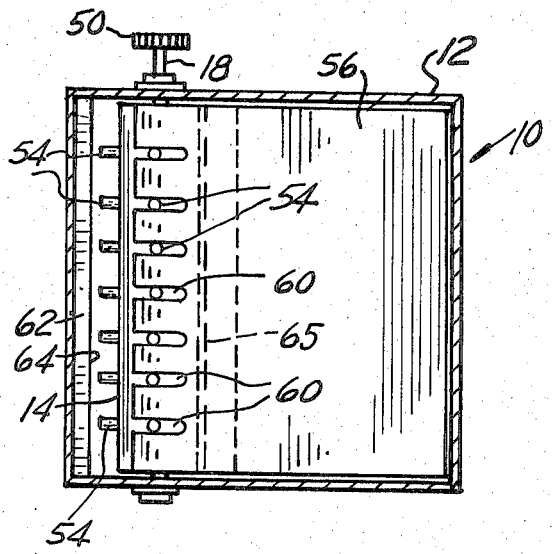
FIGS. 3, 4 and 5 are, respectively, partial sectional views, as seen, respectively, from lines 3—3, 4—4 and 5—5 of FIG. 2.
Figure 4:
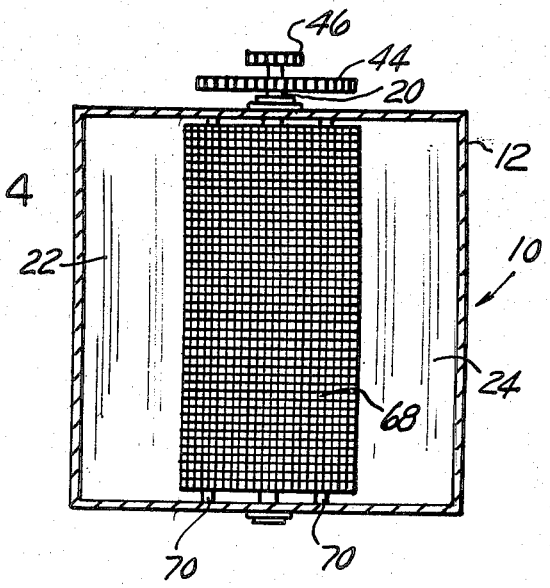
Figure 5:
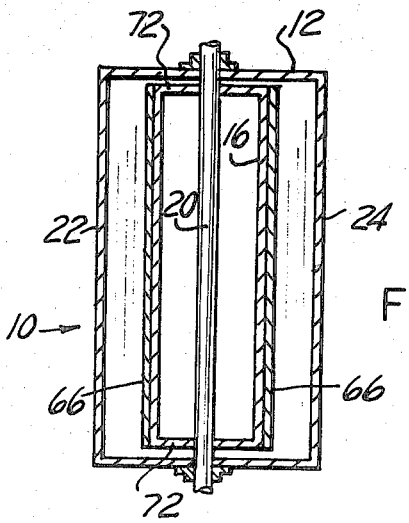

Referring to the drawings, and more particularly to FIG. 1, a grinding mill or granulator 10 according to the present invention comprises a housing 12 generally in the form of a hopper, open at the top and in which are disposed a pair of power driven drums 14 and 16, FIG. 2, mounted respectively on shafts 18 and 20 appropriately journaled through the sides of the housing 12. The housing 12 is provided at its bottom with a pair of symmetrically disposed inclined panels 22 and 24, sloping towards an outlet opening 26 provided with a removable arcuately shaped screen 28.

The housing or hopper 12 is supported from the ground by two pairs of legs 30, which also support a plate 32, disposed below the bottom of the housing 12 spaced apart therefrom. The plate 32 supports a drawer-like receptacle 34, disposed on top of the plate 32 between the legs 30. The plate 32 is provided with an extension 36 projecting on one side of a pair of legs 30 which provides the mounting base for an electric motor 37. The electric motor 37 is connectable to an electrical outlet through a line 38 and is started and stopped by means of a switch 39, the wire connecting the switch 39 to the motor 37 being installed behind the corresponding leg 30. The output shaft 40 of the electric motor 37 drives through a sprocket wheel 41 mounted on the end of the driveshaft and a chain 42 a relatively large diameter chain wheel 44 keyed on the end of the shaft 20 projecting from the housing 12. A relatively smaller diameter chain wheel 46, also keyed on the end of the shaft 20 in turn drives through a chain 48 a chain wheel 50 keyed on the projecting end of the shaft 18 on which is mounted the drum 14. A spring-urged idler 52 provides adequate tension to the chain 48 such as to prevent excessive whipping of the chain when the shaft 18 is subjected to variable torque load during operation of the granulator 10. Although it has been found that a chain tensioning idler is not required for the drive chain 42, it is readily apparent that a similar chain tensioning idler arrangement could be used to prevent excessive whipping of the chain 42, if so desired. During operation of the granulator 10, a chain guard cover is normally installed over the chain drive for safety purposes. By providing the chain wheel 46 and the chain wheel 50 with the same number of teeth, the drum shafts 20 and 18 are caused to be driven in rotation at the same speed, which is the case in the example of structure illustrated. If so desired, different gearing ratio may be used, such that one shaft is driven as at a speed different from the other.

As best shown at FIG. 2, the drum 14 supported by the shaft 18 is mounted in the housing 12 proximate a side thereof above the inclined bottom panel 22. The drum 14 is provided with a plurality of peripherally projecting fingers or pins 54. An inclined plate 56 is removably and hingedly supported at one end from a side of the hopper or housing 12, as shown at 58, and is supported by the drum 14 at its other end. A plurality of slots 60 are formed at the edge of the end of the plate 56 supported by the peripheral surface of the drum 14 such to provide passage through the slots 60 for the fingers or pins 54 when the drum 14 is driven in rotation. A crush bar 62 is welded to a side panel of the housing 12, or otherwise fastened thereto. The crush bar 62 has a side 64 which just clears the end of the fingers or pins 54 of the drum 14, while the drum rotates. The inclined plate 56 hingedly supports proximate to the drum 14 a deflector guard 65 mounted below the plate 56 which is, by gravity, caused to be in sliding engagement with the end of the drum fingers or pins 54 as the drum 14 rotates.

The drum 16, supported by the shaft 20, is mounted at the lowest level of the housing 12. The surface of the drum 16 is provided with a plurality of longitudinally extendings bars 66, and the relative dimension of the drum 16 and the thickness of the bars 66 are such that each bar, while the drum 16 rotates, is caused to superficially engage the inner surface of the removable arcuate screen 28. A screened guard 68 is disposed above the drum 16, and is held in position by a pair of support rods 70.

As illustrated, the drums 14 and 16 are preferably tubular and are provided at each end with disk-shaped end plates, as shown at 72 with respect to the drum 16, welded or otherwise fastened to the tubular member forming the drum. The end plates 72 are keyed or otherwise fastened to the corresponding shaft 18 or 20. Intermediary disk-shaped support members, not shown, may be disposed between the end plates 72 within each drum.

The bars 66 attached to the peripheral surface of the drum 16 are welded to the surface of the drum or, preferably, attached thereon by screws, not shown. The fingers or pins 54 projecting from the periphery of the drum 14 may be in the form of steel rods cut to an appropriate length, each press-fitted in an aperture through the wall of the drum 14 and welded in position. Alternatively, a thread may be formed on the end of each length of rod, and the holding aperture through the wall of the drum 14 tapped for accepting the threaded end of the rod.

In operation, broken unfired potteries and ceramics, scrap and other unfired debris are dumped in the housing or hopper 12 above the inclined plate 56, the electric motor 37 being turned on for driving the drums 14 and 16 in the direction of the arrows, FIG. 2. The scrap dumped within the hopper 12 above the inclined plate 56 slides by gravity above the rotating drum 14 and is carried by the fingers or pins 54 projecting from the surface of the drum through the slots 60 beyond the edge of the plate 56 and crushed against the crush bar 62. The combined action of the moving fingers 54 and of the stationary crush bar 62 contributes to break the larger pieces of scrap into smaller pieces which fall on the top of the inclined panel 22. Pieces of scrap small enough to pass between the fingers or pins 54 of the drum 14, and the pieces broken by the fingers or pins 54 against the crush bar 62, slide by gravity along the inclined panel 22, are caught and crushed between the bottom of the panel 22 and the bars 66 of the rotating lower drum 16 and between the bars 66 and the curvilinear screen 28, and are granulated and pulverized and caused to pass through the mesh of the screen 28 into the receptacle 34, in the form of powder which may be reused, for example in the ceramic industry, for making a slurry simply by addition of water. The arrangement formed by the deflector guard 65 suspended from the inclined plate 56 and the screen 68 over the rotating drum 16 direct scrap pieces that may adhere to the drum 14 or that may be caught between the fingers 54 towards the inclined panel 22.

Having thus disclosed the present invention by way of a structural embodiment thereof, modification whereof will be apparent to those skilled in the art, what is claimed as new is as follows:

1. An apparatus for granulating articles, said apparatus comprising a housing, a first rotatable drum disposed in said housing proximate a side thereof, said first drum having a plurality of elongated members peripherally projecting therefrom, a bar attached to said side of said housing and disposed relative to said first drum such that said projecting members pass proximate the edge of said bar when said first drum rotates, an inclined plate hingedly mounted at one end to an opposite side of said housing and supported at its other end by said first drum, slots in said other end of said plate for clearing said projecting members on said first drum, said inclined hinged plate defining a chute for articles to be granulated, a stationary inclined panel mounted under said first drum and forming a gravity chute for said articles after said articles have passed between said bar and said members projecting from said drum, a second rotating drum disposed at the bottom of said inclined panel, a plurality of crush bars longitudinally mounted on the periphery of said second drum, an opening at the bottom of said inclined panel, a curvilinear mesh screen mounted over said opening, said curvilinear mesh screen having an inner surface and an outer surface wherein each bar is caused to superficially engage said inner surface of said curvilinear mesh screen while said drum rotates, and whereby said broken articles are further crushed against said inclined panel and said mesh screen and passed through said mesh screen.

2. The apparatus of claim 1 further comprising a stationary curvilinear guard disposed above said second rotating drum.

3. The apparatus of claim 1 further comprising a second plate hingedly attached below said first plate and supported therefrom at an angle causing a surface of said second plate to engage the tip of said projecting members of said first drum as said first drum rotates.

4. The apparatus of claim 1 further comprising power drive means for driving said first and second drums.

5. The apparatus of claim 4 wherein said power drive means comprises an electric motor, chain drive means from said electric motor to said second drum, and chain drive means from said second drum to said first drum.

* * * * *